US007887472B2

(12) United States Patent
Pandozy

(10) Patent No.: US 7,887,472 B2
(45) Date of Patent: Feb. 15, 2011

(54) HORIZONTAL ROTARY TORSO EXERCISING APPARATUS AND METHOD

(76) Inventor: Raffaele Martini Pandozy, 2312 Grand Ave., Apt. A, Dallas, TX (US) 75215

( * ) Notice: Subject to any disclaimer, the term of this patent is extended or adjusted under 35 U.S.C. 154(b) by 0 days.

(21) Appl. No.: 12/381,084

(22) Filed: Mar. 6, 2009

(65) Prior Publication Data

US 2009/0227435 A1 Sep. 10, 2009

Related U.S. Application Data

(60) Provisional application No. 61/068,589, filed on Mar. 7, 2008.

(51) Int. Cl.
*A63B 26/00* (2006.01)

(52) U.S. Cl. ..... 482/142; 482/140

(58) Field of Classification Search ..... 482/94–100, 482/136–138, 139, 51; 5/606, 610–611, 5/613–618; D21/676, 686, 690; 601/1, 5
See application file for complete search history.

(56) References Cited

U.S. PATENT DOCUMENTS 6,764,432 B2 * 7/2004 Hippensteel ..... 482/56
7,691,042 B2 * 4/2010 Pandozy ..... 482/142

* cited by examiner

*Primary Examiner*—Lori Baker
(74) *Attorney, Agent, or Firm*—Schultz & Associates, P.C.

(57) ABSTRACT

A horizontal rotary torso exercising apparatus allows a user to strengthen the core muscles of the body and obtain maximum flexibility of the spine without squeezing or pinching the intervertebral discs or nerves. The apparatus is comprised of a frame supporting a longitudinally adjustable bench covered by a contoured pad. The contoured pad follows the natural curvature of the spine by providing a raised lumbar region with lateral pads. A rod is supported by the frame with two collars including bearings. At one end of the rod is a rack for holding weights and at the opposite end is a height adjustable leg rest. The user lies supine on the bench, places knees over the leg rest, and rotates the lower body at the waist side to side through a number of repetitions. The movement rotates the leg rest, the rod, and the rack about the axis of the rod.

9 Claims, 2 Drawing Sheets

HORIZONTAL ROTARY TORSO EXERCISING APPARATUS AND METHOD

CROSS-REFERENCE TO RELATED APPLICATIONS

This application claims priority benefit from U.S. Provisional Patent Application Ser. No. 61/068,589 entitled "Apparatus and Method for Performing Horizontal Rotary Torso Exercises" filed on Mar. 7, 2008.

FIELD OF THE INVENTION

The present invention relates to exercise apparatus. In particular, the invention relates to a horizontal rotary torso exercising apparatus for strengthening the core muscles with a twisting motion while the operator lies supine on a spine supporting bench.

BACKGROUND OF THE INVENTION

The prior art contains many exercise machines aimed at strengthening the core muscles of the human body by performing a twisting action. The twisting action has a strengthening effect and is also a miraculous remedy against muscle spasms, stiffening of the back, and atrophic conditions. Those who practice sports such as golf, tennis, or basketball where sudden rotation of the body is often required benefit greatly from a well conditioned core muscle group. Typically, the apparatus of the prior art orient the body in a seated upright position while performing the twisting movements. The problem with performing the twisting movements while in a seated upright position is that the spine, particularly the intervertebral discs are under compression and the cartilage, as well as, the intervertebral nerves may be squeezed and pinched during the twisting movement. Moreover, vertebrae under compression may grind on each other during the twisting motion causing bone erosion and arthritis in addition to possibly damaging the discs, cartilage, and spinal cord. Adding additional weight or resistance to the movement only exacerbates the problem.

Therefore there is a need for an exercise machine designed to strengthen the core muscles of the human body from the horizontal position and provide the desirable flexibility of the spine.

One advantage of the disclosure of this apparatus is the pressure on the intervertebral discs and the cartilage around the individual vertebrae of the spine typically associated with upright exercise machines is not present because of the horizontal position of the user. A further advantage is horizontal rotary torso exercises encourage pelvic mobility and spinal flexibility because they open the intervertebral space for free movements of the spine so that discs, cartilage, and nerves are stress free. Still a further advantage is the effective training and strengthening of the entire set of abdominal muscles, such as the internal and external oblilques and gluteus maximum; the internal and external muscles of the thighs, the iliotibial bands, the abductors, and upwards to the erectors sacro spinals; the posterior layers of the lumbar region, the longissimus, the iliocostalis, the serratus, and the spleniuses; and the traverses all from the horizontal position.

SUMMARY OF INVENTION

One preferred embodiment provides an exercise platform where a user can perform comprehensive horizontal rotary torso exercises. The user will obtain maximum results because the horizontal position and the elevation of the legs concentrate the action on the spine and the lower muscle region of the torso. The preferred embodiment relieves the compression forces, the friction, and the grinding of the intervertebral discs and cartilage around the vertebrae that are present when performing twisting movements in a seated upright position. The preferred embodiment provides the user with increased pelvic mobility and spinal flexibility while strengthening the abdominal and lumbar muscles. Additionally, the preferred embodiment decompresses the lumbar section of the vertebral column, relieves muscle and nerve tension, prevents stiffness, stops muscle spasms, and helps rejuvenate the intervertebral discs.

Accordingly, an embodiment of the apparatus provides an exercise platform with an elevated leg rest where a user can perform horizontal rotary torso exercises free from spinal compression and concentrate the action in the desired muscle area. The apparatus includes a four-legged frame with a longitudinally adjustable contoured pad. The contoured pad is longitudinally adjustable with respect to the frame to accommodate users of differing heights. The contour of the pad follows the natural curvature of the spine by providing a raised lumbar region including lateral pads. The contoured pad includes an internal support structure which includes linear bearings that slide along rails attached to the frame. The apparatus further includes an adjustable headrest and two pairs of handgrips attached to the internal support frame. A rod spans the length of the apparatus and is supported by the frame with two collars. The collars include bearings to allow the rod to rotate freely. At one end of the rod is a rack for adding additional weight. At the opposite end of the rod is an upright sleeve which telescopically houses a vertically adjustable leg rest including a set of knee pads. The upright sleeve also includes a pair of foot pegs.

To perform horizontal rotary torso exercises, a user lies supine on the contoured pad, places the knees over the leg rest and on the set of knee pads and positions feet under the foot pegs. Once in position, the user initiates movement by rotating the lower body at the waist while the upper body remains adjacent the contoured pad. The movement is continued, potentially through a full 180° range of motion, side to side for a set number of repetitions. The upright sleeve including the leg rest, the rod, and the rack all rotate about the longitudinal axis of the rod responding to the user's lower body movement. The user may brace the upper body by holding either pair of handgrips. Free weights may be added to the rack for additional resistance.

Those skilled in the art will appreciate the above-mentioned features and advantages of the invention together with other important aspects thereof upon reading the detailed description that follows in conjunction with the drawings provided.

BRIEF DESCRIPTION OF THE DRAWINGS

In the detailed description of the preferred embodiments presented below, reference is made to the accompanying drawings.

DETAILED DESCRIPTION OF THE PREFERRED EMBODIMENT

Figure 1:
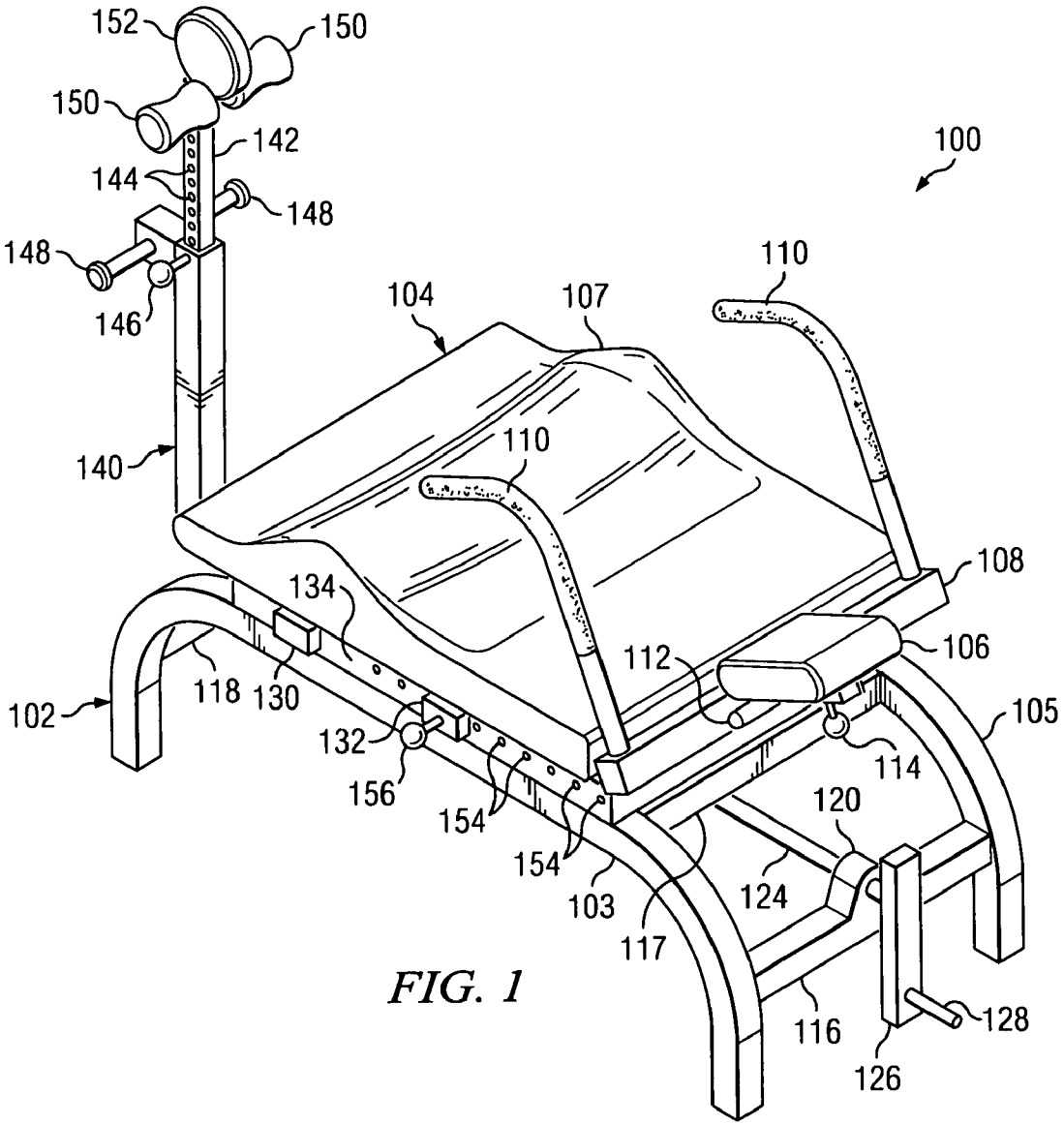
FIG. 1 is an isometric view of a preferred embodiment of the present invention.

In the descriptions that follow, like parts are marked throughout the specification and drawings with the same numerals, respectively. The drawing FIGS. are not necessarily drawn to scale and certain FIGS. may be shown in exaggerated or generalized form in the interest of clarity and conciseness.

Figure 2:
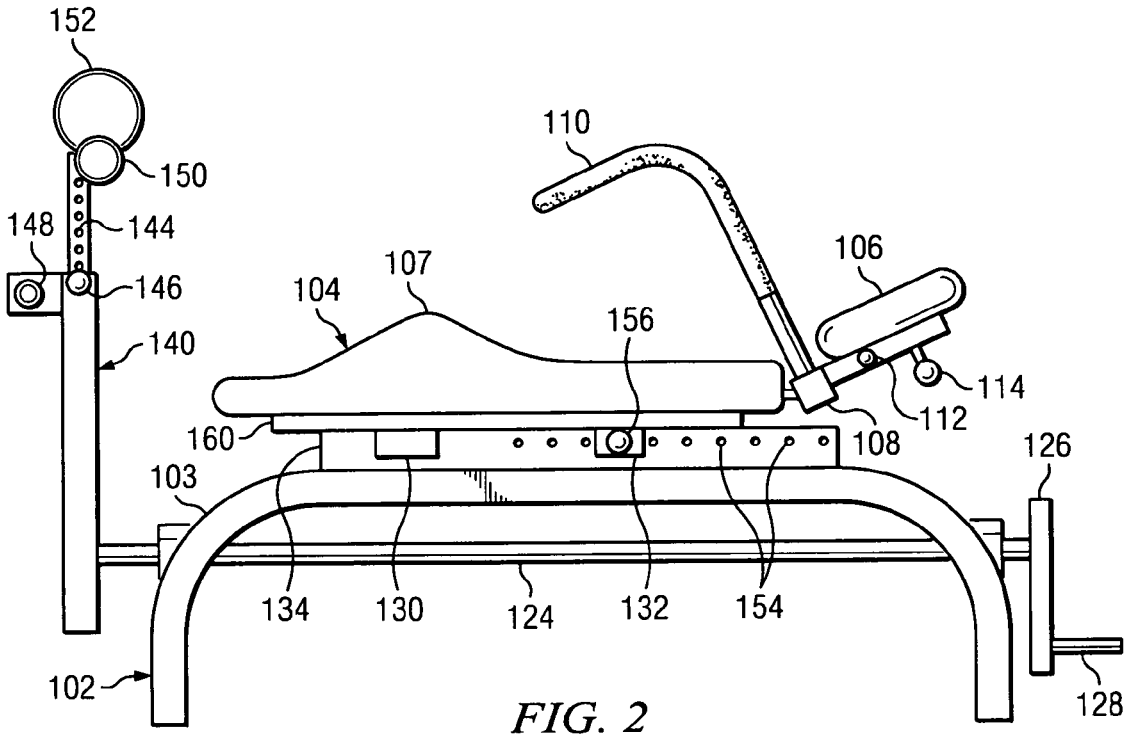
FIG. 2 is an elevation view of a preferred embodiment of the present invention.
Figure 3:
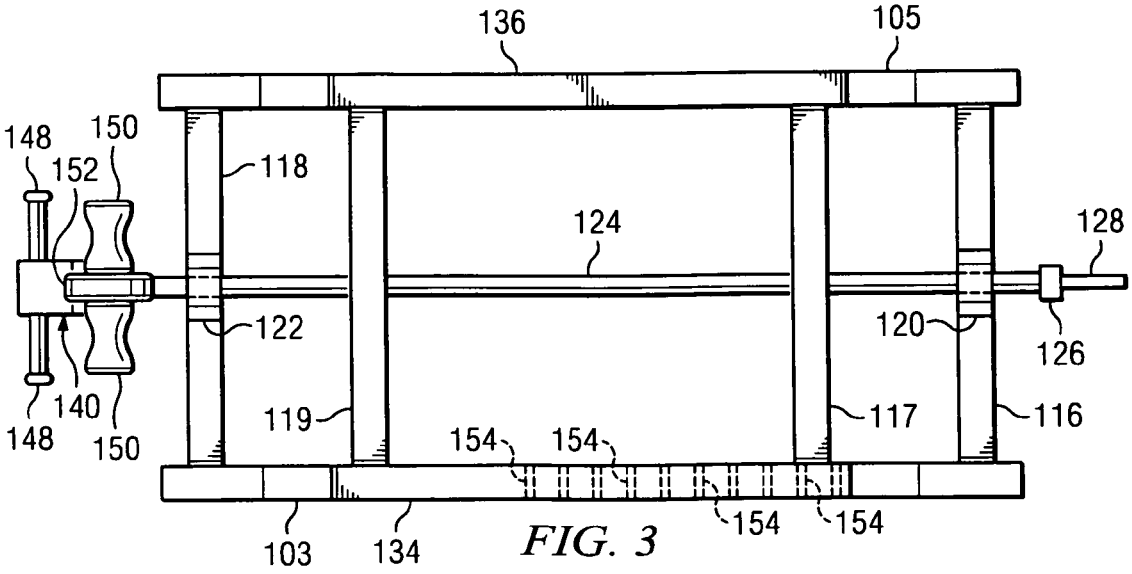
FIG. 3 is a plan view of from the top a preferred embodiment of the present invention showing the frame and rails.

Referring to FIGS. 1-3, rotary torso exercising apparatus 100 is comprised of a frame supporting a bench, a leg rest, a rotatable rod, and a weight stack. The bench adjustably rests on top of the frame. The leg rest is connected to the weight stack by the rotatable rod. The leg rest, rotatable rod, and the weight stack are supported by crosspieces underneath the bench. Frame 102 is comprised of two inverted U-shaped supports forming the body of the frame and four legs. The two supports 103 and 105 are connected to each other by four crosspieces 116, 117, 118, and 119. In a preferred embodiment, frame 102 is constructed of hollow tubular or square steel or aluminum approximately ⅛ inch thick and approximately two inches in width. Mounted in linear alignment with and atop support 103 is rail 134. Mounted in linear alignment and atop support 105 is rail 136.

Bench 104 is comprised of bench frame 160 covered by contoured pad 107. Bench frame 160 is generally rectangular in shape and provides a skeleton for contoured pad 107. Contoured pad 107 is made of firm plastic foam cushion wrapped in nylon or leather and is shaped to follow the natural curvature of the spine by providing a raised lumbar region including lateral pads. Contoured pad 107 extends over the upper portion of all exterior edges of bench frame 160. Crossbar 108 is connected to bench frame 160 and provides a mounting point for headrest 106. Headrest extends from crossbar 108 at approximately a 30 degree angle. Head rest 106 includes a pair of handgrips 112 extending transversely from opposite sides. Head rest 106 is longitudinally adjustable through the use of spring loaded pin 114. An additional pair of handgrips 110 extends parallel to each other from the bench at opposite ends of crossbar 108. Two linear bearing are mounted to each longitudinal side of bench frame 160 for engagement with rails 134 and 136. Linear bearings 130 and 132 slidably engage rail 134. The linear bearings engaging rail 136 are not shown. Each pair of linear bearings are spaced equidistant along the length of each longitudinal side of bench frame 160. Rail 134 includes a plurality of linearly aligned holes 154 passing perpendicularly through the width of rail 134. Linear bearing 132 includes spring loaded pin 156 for engagement with holes 154.

The leg rest is comprised of upright 140 which telescopically houses shaft 142. Extending from opposite lateral sides of upright 140 is a pair of foot pegs 148. Shaft 142 includes a plurality of linearly aligned holes 144 passing perpendicularly through the width of shaft 142. One end of shaft 142 is housed in and slides telescopically within upright 140 while the opposite end provides a mounting point for pads 150 and cushion 152. Pads 150 are generally cylindrical in shape and have a contoured middle. Cushion 152 is a flat semicircular shaped pad extending perpendicularly between each pad of pads 150. Upright 140 includes spring loaded pin 146 for engagement with holes 144.

Upright 140 is connected to one end of rod 124. Rod 124 is supported by crosspieces 116 and 118. Mounted on crosspiece 116 is collar 120 and mounted on crosspiece 118 is collar 122. Rod 124 passes through both collars 120 and 122. Collars 120 and 122 each include a rotary bearing in order to allow rod 124 to rotate when sufficient force is applied. The opposite end of rod 124 is connected to link 126. Link 126 provides a mounting point for rack 128.

To properly perform the horizontal rotary torso exercise, the adaptable components of the apparatus should be appropriately adjusted for the height of the user. Specifically, the height of pads 150 can be adjusted, the longitudinal position of bench 104 may be adjusted, and the position of headrest 106 may be altered. A taller user will require pads 150 to be higher, bench 104 to be further from upright 140, and headrest 106 to be further from bench 104.

To adjust the height of pads 150, pin 146 is disengaged from holes 144. With pin 146 disengaged, shaft 142 is free to slide in and out of upright 140. When pads 150 are the proper height for the user, pin 146 is released and the spring action reengages pin 146 with holes 144. To adjust the longitudinal position of the bench relative to upright 140, pin 156 is disengaged from holes 154. With pin 156 disengaged, the linear bearings attached to the bench allow the bench to slide longitudinally along rails 134 and 136. When the bench is in the proper position for the user, pin 156 is released and the spring action reengages pin 156 with holes 154. To adjust the position of headrest 106, pin 114 is disengaged from headrest 106. With pin 114 disengaged, headrest 106 is free to move longitudinally towards and away from bench 104. When headrest 106 is in the proper position for the user, pin 114 is released and pin 114 reengages with headrest 106 to hold it in place.

Once all the adaptable components of the apparatus are properly positioned, the user lies supine adjacent bench 104 positioning the user's head on headrest 106. Contoured pad 107 follows the natural curve of the spine and therefore relieves any compressive forces on the intervertebral discs and cartilage around the vertebrae. The user places the knees over pads 150 with cushion 152 adjacent and in between the knees. The user positions the feet under foot pegs 148. Once in position, the user rotates the lower body at the waist while the upper body remains adjacent contoured pad 107. The movement is continued, potentially through a full 180° range of motion, side to side for a set number of repetitions. The movement of the user's lower body causes upright 140 including pads 150, rod 124, and rack 128 to all rotate about the longitudinal axis of rod 124. The user may brace the upper body by grabbing handgrips 110 or handgrips 112. Free weights may be added to rack 128 for additional resistance.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

The invention claimed is:

1. A method of obtaining maximum spinal flexibility and strengthening the core muscles of a user having a lower body, a waist, an upper body, knees, feet and hands while maintaining intervertebral space, the method comprising:

providing a frame supporting a horizontally oriented adjustable bench;

providing an adjustable leg rest having a set of pads separated by a cushion and rigidly connected to a rod, where the rod is rigidly connected to a rack and where the rod is rotationally supported by a set of collars rigidly attached to the frame;

providing a set of foot pegs extending transversely from opposite sides of the leg rest providing an adjustable headrest rigidly affixed to the bench;

adjusting the leg rest to an appropriate height;

adjusting the bench to an appropriate position;

adjusting the headrest to an appropriate position;

lying supine adjacent the bench;

placing the knees over the set of pads and separating the knees with the cushion;

placing the feet underneath the set of foot pegs; and, rotating the lower body at the waist side to side for a number of repetitions.

2. The method of claim 1 further comprising, causing the leg rest, the rod, and the rack to rotate about the longitudinal axis of the rod.

3. The method of claim 1 where the step of adjusting the leg rest to an appropriate height further comprises:

disengaging a locking pin attached to the leg rest;

adjusting the height of the leg rest; and, reengaging the first locking pin.

4. The method of claim 1 where the step of adjusting the bench to an appropriate position further comprises:

disengaging a locking pin between the bench and the frame;

adjusting the longitudinal position of the bench relative to the leg rest; and, reengaging the locking pin.

5. The method of claim 1 where the step of adjusting the head rest to an appropriate position further comprises:

disengaging a locking pin attached to the head rest;

adjusting the longitudinal position of the head rest relative to the bench; and, reengaging the locking pin.

6. The method of claim 1 where the step of rotating the lower body at the waist side to side for a number of repetitions further comprises:

continuing the rotation through a full 180 degree range of motion; and, maintaining the upper body adjacent to the bench.

7. The method of claim 1 further comprising adding additional free weights to the rack.

8. The method of claim 1 further comprising bracing the upper body by grabbing a set of handgrips affixed to the bench.

9. The method of claim 1 further comprising bracing the upper body by grabbing a set of handgrips affixed to the headrest.

* * * * *